US005328516A

United States Patent [19]

Dietiker

[11] Patent Number: 5,328,516

[45] Date of Patent: Jul. 12, 1994

[54] MODULAR PLASMA GUN ASSEMBLY FOR COATING THE INNER SURFACES OF HOLLOW SPACES AND CAVITIES

[75] Inventor: Markus Dietiker, Aarau, Switzerland

[73] Assignee: Plasma-Technik AG, Wohlen, Switzerland

[21] Appl. No.: 106,132

[22] Filed: Aug. 13, 1993

[30] Foreign Application Priority Data

Aug. 24, 1992 [DE] Fed. Rep. of Germany ..... 4228064

[51] Int. Cl.[5] ..... C23C 4/12

[52] U.S. Cl. ..... 118/723 DC; 118/715; 118/724; 219/121.48; 219/121.5

[58] Field of Search ..... 118/723 DC, 715, 724; 156/DIG. 68; 219/121.47, 121.48, 121.49, 121.5, 121.51, 121.52

[56] References Cited

U.S. PATENT DOCUMENTS 4,830,702 5/1989 Singh et al. ..... 156/DIG. 68 X 5,099,788 3/1992 Ito et al. ..... 118/723 DC X

*Primary Examiner*—Brian E. Hearn
*Assistant Examiner*—Jonathan D. Baskin
*Attorney, Agent, or Firm*—Tarolli, Sundheim & Covell

[57] ABSTRACT

The plasma gun assembly of the invention is particularly suitable for coating the inner surfaces of narrow cavities, bores, channels or the like. It essentially comprises a plasma gun head member, a plasma gun shaft member and a connector member. These three units are designed as replaceable modules which can be replaced by the operator of the plasma gun assembly quickly and easily. The plasma gun head member is connected to the plasma gun shaft member by means of only two screws, and the connector member is connected to the plasma gun shaft member by means of only three screws. All channels, conductors and conduits for supplying the media and the electric energy required for the operation of the plasma gun assembly are running in the interior of the plasma gun shaft assembly.

30 Claims, 8 Drawing Sheets

1
2
3
4
5
6
7
8
9
10
11

Ansicht A
Ansicht B
Ansicht C
A
B
C
1
2
3
6
7
9
11
15
15A
15B
17
18
19
20
21
22
23
25
26
27
28
30
31
32
33
34
36

MODULAR PLASMA GUN ASSEMBLY FOR COATING THE INNER SURFACES OF HOLLOW SPACES AND CAVITIES

FIELD OF THE INVENTION

The present invention refers to a plasma gun assembly particularly for applying a coating to the inner surfaces of hollow spaces and cavities, comprising a plasma gun head member, a plasma gun shaft member and a connector member adapted to be connected to means for supplying electric energy, to means for supplying a cooling medium and for removing the cooling medium therefrom, to means for supplying plasma gas, and to means for supplying coating material, whereby the connector member, the plasma gun shaft member and the plasma gun head member are connected to each other along a longitudinal axis constituting a longitudinal central axis of the plasma gun assembly.

BACKGROUND OF THE INVENTION

The operation of coating outer surfaces of workpieces which are readily accessible by means of a plasma gun assembly known in the art usually can be performed without any problems. However, if inner surfaces of cavities have to be coated by using a plasma gun assembly known in the art, e.g. the inner surfaces of bores, channels, tubes and the like, various problems and difficulties arise.

One of the main problems in coating inner surfaces of cavities is the length of the bore or channel to be coated. As the connector portion of a known plasma gun assembly usually is much bigger then the plasma gun shaft member and the plasma gun head member mounted at the end of the shaft member, it is not possible to introduce the entire plasma gun assembly into the bore ore channel to be coated on its interior surface. In order to provide for a plasma gun assembly which is small and easily maintainable, suitable for short bores and channels, and for a plasma gun assembly usable for bores and channels of greater length, the design of the plasma gun assembly must be correspondingly adapted, at least as far as the portions thereof are concerned which are introduced into the interior of the bore or channel to be coated.

The outer diameter of a plasma gun assembly, particularly the diameter of its shaft member and its head member located at the end of the shaft member, determines the minimal size of the bore or channel whose interior surface has to be coated. In other words, the smaller the plasma gun head member and the plasma gun shaft member are, the smaller can be the diameter of the bore ore channel to be coated.

In order to provide for a homogeneous coating, particularly of angled and tortuous portions thereof, the plasma torch created by the plasma gun head member preferably should escape from it radially with respect to longitudinal axis of the plasma gun assembly.

A further problem is the heating-up of the parts and portions of the plasma gun assembly which are in the interior of the bore ore channel to be coated during the coating operation. It is well known in the art that temperatures in the region of 10'000° C. can occur during a coating operation by means of a plasma gun assembly. This problem is even much more serious if the coating operation is performed under conditions in which the ambient pressure is less than the atmosphere pressure, particularly under vacuum or near vacuum conditions, since in this case a blowing-in of air or carbon dioxide is not possible to cool the hot parts of the plasma gun assembly as is possible if the coating operation takes place under atmospheric conditions. In order to avoid a damage of the parts and portions of the plasma gun assembly under atmospheric condition and particularly also under near-vacuum conditions, an efficient cooling of the plasma gun shaft member and the plasma gun head member must be provided.

In coating of narrow tubes and similar workpieces, a further problem to be considered is the electrical insulation of the plasma gun head member. Particularly in the case where a transferred arc is used, the shortest path thereof often being not identical with the course of the desired path between the cathode and the surface to be coated, for instance the inner wall of a tube, great care must be taken that the plasma gun head member is provided with a good insulation all over its circumference. In plasma gun assemblies known in the art, there is a danger that an undesired transformation of the plasma torch to the workpiece can take place if the electrical insulation of the plasma gun head member is damaged or impaired by the precipitation of dust, particularly if the plasma gun assembly is operated under vacuum conditions. Thus, the plasma gun assembly and particularly the plasma gun head member should be designed in such a way that the electrical insulation of the head member prevents an undesired transferring of the plasma torch to the workpiece surface to be coated.

PRIOR ART

Known in the art is a plasma gun assembly for the coating of the inner surfaces of a tube which is marketed by "METCO, Westbury, U.S.A." under the brand name "TYPE 7 MST-2". This known plasma gun assembly essentially consists of a connector member and an extension member which can be connected to the connector member, said extension member being provided with an integrally formed plasmatron. The supply of plasma gas as well of electrical energy for operation of the plasmatron is effected trough the interior of said extension member while the supply of plasma powder is realized through a conduit running outside of said extension member.

In order to fix the extension member to the connector member, a sleeve is pushed over the extension member and screwed onto the connector member to press the extension member to the connector member.

The plasma powder conduit is externally connected to the extension member by means of clamps surrounding the extension member. At the end of the extension member, a separate flange must be connected in which the plasma powder conduit has to be screwed in. This flange comprises powder guiding means through which the coating material, usually plasma powder, is supplied to the plasma torch at the exterior of the plasmatron. The other end of the plasma powder conduit is screwed to a plasma powder supply pipe located in the region of the connector member.

The plasmatron integrated in the aforementioned extension member is axially flushingly placed with reference to the extension member; the result is that the plasma torch escapes from the plasmatron in axial direction as well. In order to deflect the plasma torch, there is provided a deflection nozzle by which the plasma torch is deflected by 40°-50° with reference to the central longitudinal axis of the plasma gun assembly.

The design of the plasma gun assembly described above involves some serious disadvantages:

Due to the fact that each extension member is provided with an integrated plusmatron, the replacement stock is very expensive.

Due to the fact that the plasma torch escapes in axial direction from the plusmatron, tortuous portions in the interior of a bore or channel can not be coated reliably. Even by providing a deflection nozzle which deflects the plasma torch by 40°-50° with reference to the longitudinal axis of the plasma gun assembly, shoulders and similar irregularities in the interior of a bore or channel cannot be coated reliably, particularly if such portions are accessible only from one side of the bore or channel.

The replacement of individual components or elements of the plusmatron, as for instance the anode or cathode, by the operator of the plasma gun assembly is not possible or nearly impossible.

The cooling efficiency of the plasma gun assembly, particularly as far as the plasma powder conduit is concerned, is quite bad.

The replacement of the extension member is complicated and requires quite a lot of time.

For each extension member, a corresponding plasma powder conduit must be available which additionally has to be separately connected to the extension member. Furthermore the plasma powder conduit has to be connected to the plasma powder supply tube at the one side thereof and to a flange at the other side thereof.

Due to the fact that connection means are required for fixing the plasma powder conduit at the outside of the extension member, it is possible that heat congestion can occur due to the hot gases escaping from the bore or channel to be coated. Furthermore, these connection means are exposed to extreme contamination and to the danger of damage.

OBJECTS OF THE INVENTION it is an object of the present invention to provide a plasma gun assembly which avoids the disadvantages mentioned above. Particularly it is an object of the present invention to provide a plasma gun assembly which can be adapted simply and quickly to different coating tasks. A still further object of the invention is to provide a plasma gun assembly which can be used for the coating of different internal surfaces of cavities as they appear in tubes, channels, bores and the like even if they have a tortuous shape. Still further, it is an object of the invention to provide a plasma gun assembly which is of modular design and in which all the modular units, particularly the plasma gun shaft member, can be exchanged simply and quickly by the operator itself.

SUMMARY OF THE INVENTION

To meet these and other objects, the invention provides a plasma gun assembly particularly for applying a coating to the inner surfaces of hollow spaces and cavities, comprising a plasma gun head member, a plasma gun shaft member and a connector member adapted to be connected to means for supplying electric energy, to means for supplying a cooling medium and for removing the cooling medium therefrom, to means for supplying plasma gas, and to means for supplying coating material.

Further provided are first feeding means for conducting the electric energy from the connector member to the plasma gun head member, second feeding means for conducting the cooling medium from the connector member to the plasma gun head member and back to the connector member, third feeding means for conducting the plasma gas from the connector member to the plasma gun head member, and fourth feeding means for conducting the coating material from the connector member to the plasma gun head member.

The connector member, the plasma gun shaft member and the plasma gun head member are connected to each other along a longitudinal axis which constitutes a longitudinal central axis of the plasma gun assembly, whereby the connector member, the plasma gun shaft member and the plasma gun head member are designed as individually exchangeable modules which can be removed, exchanged and assembled by the operator of the plasma gun assembly;

The aforementioned first, second, third and fourth feeding means all are located and extend in the interiors of the connector member, of the plasma gun shaft member and of the plasma gun head member.

Due to the modular design of the plasma gun assembly, the same connector member and particularly the same plasma gun member can be used for practically each coating task with different plasma gun shaft members of varying length or shape. Does an individual adaptation of the plasma gun assembly to bores, channels and the like of different length can be realized. In other words, if a short cavity has to be coated, the plasma gun assembly is equipped with a correspondingly short shaft member with the result that the plasma gun assembly can be handled easier. If a long cavity has to be coated, the same connector member and the same plasma gun head member can easily connected by means of a longer shaft member.

Due to the fact that the plasma gun head member is an independent module which easily and quickly can be connected to different shaft members, only one connector member and only one plasma gun head member can be used in connection with a plurality of inexpensive shaft members different in shape and/or length thereby, the costs of keeping the replacement parts in stock are considerably lowered. Due to the modular construction of the plasma gun assembly according to the invention, the time required for the adaptation of the plasma gun assembly to a particular coating task is considerably reduced.

According to a preferred embodiment, the connector member, the plasma gun shaft member and the plasma gun head member each comprise matching plug-and-socket connector means and/or matching face-to-face connector means for interconnecting the aforementioned first, second, third and fourth feeding means between the connector member, the plasma gun shaft member and the plasma gun head member, respectively.

BRIEF DESCRIPTION OF THE DRAWINGS

In the following, an embodiment of the plasma gun assembly according to the invention will be further described, with reference to the accompanying drawings, in which.

DETAILED DESCRIPTION OF A PREFERRED EMBODIMENT

Figures 1A, 1B:
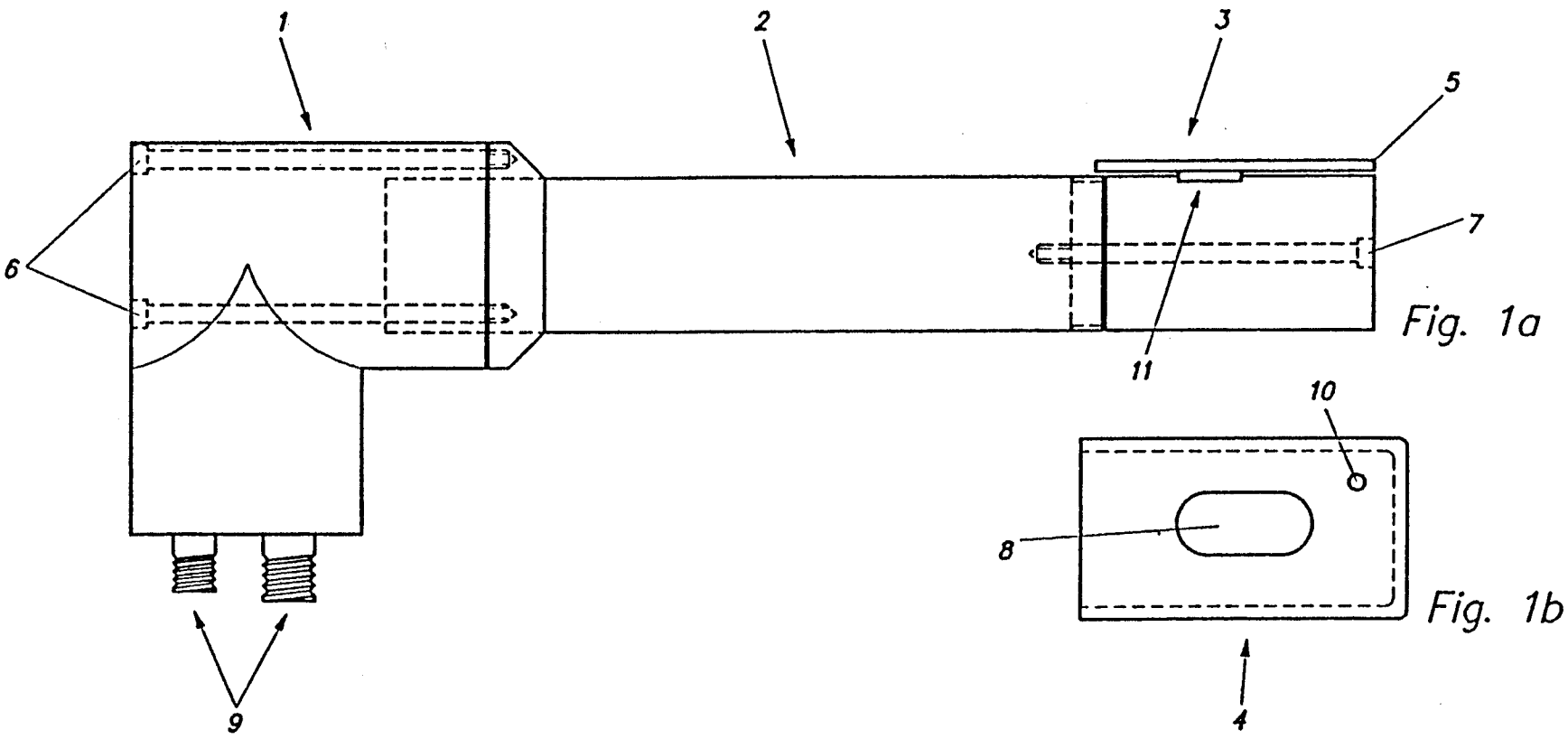
FIGS. 1*a* and 1*b* show a diagrammatic view of the assembled plasma gun.

In FIG. 1*a*, there is shown a plasma gun assembly in an assembled condition ready for use. This plasma gun assembly essentially consists of three modular units. The three modular units are constituted by a connector member 1, a plasma gun shaft member 2 and a plasma gun head member 3. The connector member 1 is fixed to the plasma gun shaft member 2 by means of screws 6 and the plasma gun head member 3 is fixed to the plasma gun shaft member 2 by means of screws 7. The supply of the media required for the operation of the plasma gun assembly is accomplished via not shown pipes and conductors from a (not shown) supply unit to the connector member; for this purpose, the connector member 1 is provided with diagrammatically shown connectors 9 which may be designed as screw connectors and plug-in connectors, respectively. The connectors 9 extend in radial direction with reference to the central longitudinal axis of the plasma gun assembly.

As can be further seen from FIG. 1*a*, the plasma gun head member 3 comprises an anode nozzle 11; in operation, the plasma torch escapes from this anode nozzle 11 in a direction running perpendicularly to the central longitudinal axis of the plasma gun assembly, i.e. in radial direction. Further shown in FIG. 1*a* is a protection shield member 5. In FIG. 1*b*, there is shown a ceramic cap 4 which can be mounted on the plasma gun head member 3 in order to provide for a thermal and electric insulation of the plasma gun head member 3. This ceramic cap comprises an oval aperture 8 as well as a bore 10. The ceramic cap 4 being mounted on the plasma gun head member 3, the oval aperture 8 allows the plasma torch to escape from the anode nozzle 11, and the bore 10 serves for fixing the ceramic cap 4 to the plasma gun head member 3, for instance by putting a (not shown) fixing screw through the bore 10 and securing it in a threaded bore (not shown) provided in a corresponding location of the plasma gun head member 3. Constructive and other design details are not evident from these two figures because such further details will be described with reference to and in connection with other drawing figures herein below. However, any person skilled in the art readily recognizes the compact design of the plasma gun assembly from these FIGS. 1*a* and 1*b*.

Figures 2A, 2B, 2C, 2D, 2E, 2F:
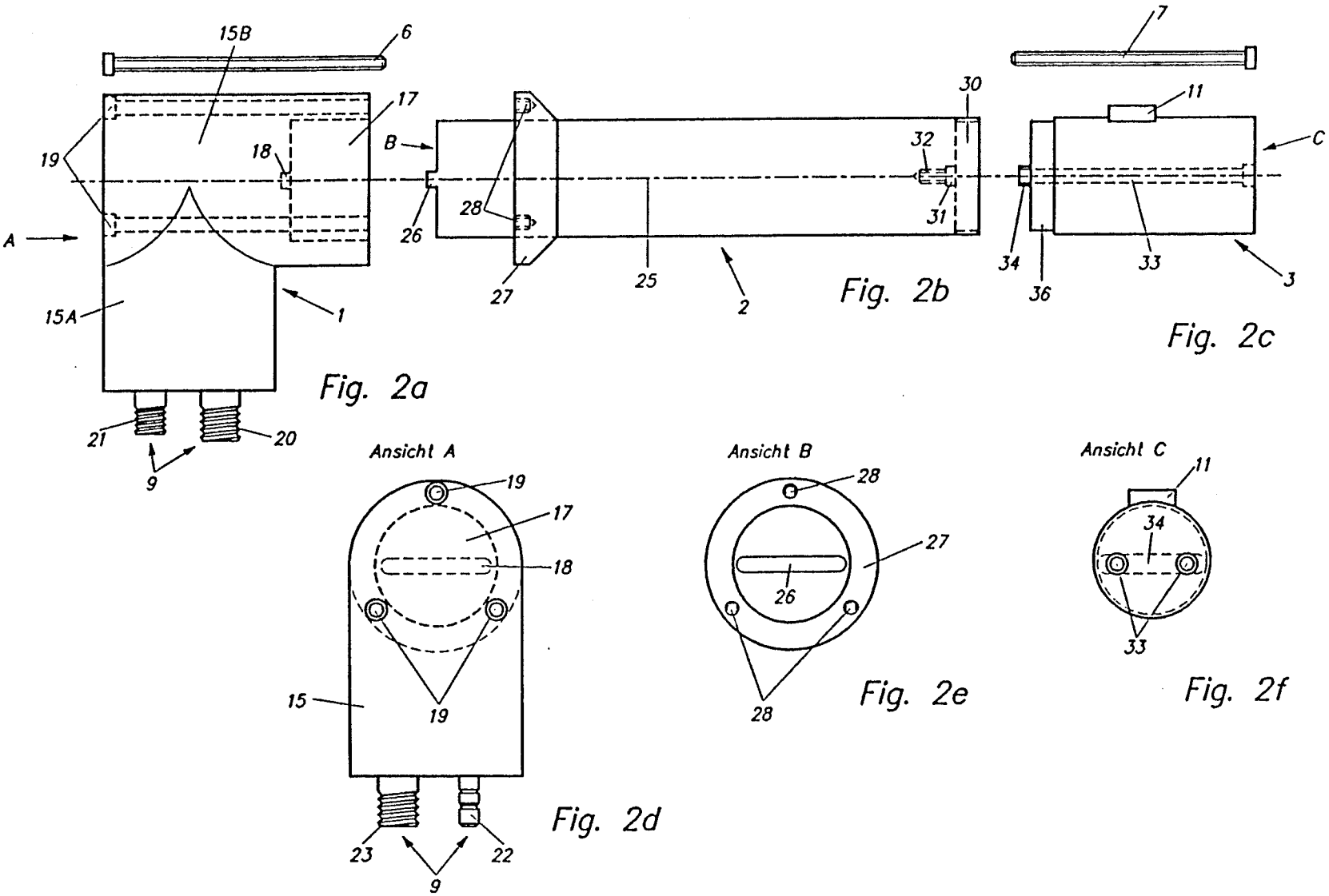
FIGS. 2*a* to 2*f* show diagrammatic views of the three modules of the plasma gun assembly and of the kind of interconnection thereof.

The FIGS. 2*a*, 2*b* and 2*c* diagrammatically show the parts and details which are essential for the fixing and interconnection, respectively, of the three modules 1, 2 and 3. For the purpose of better understanding and illustration, the three modules 1, 2 and 3 of the plasma gun assembly are individually shown in a lateral view. Furthermore, in FIG. 2*d*, the connector member 1 is shown in a diagrammatic view from the rear side, in the direction of arrow A in FIG. 2*a*, in FIG. 2*d*, the plasma gun shaft member is shown in a diagrammatic view from the side facing the connector member 1, in the direction of arrow B in FIG. 2*b*, and in FIG. 2*f*, the plasma gun head member 3 is shown in a diagrammatic view from the front side, in the direction of arrow C in FIG. 2*c*.

The connector member 1 designed and adapted for the connection of supply conduits and conductors of media and energy for the operation of the plasma gun assembly essentially is constituted by a basic body member comprising a first portion 15A and a second portion 15B both having circular cross section and running perpendicularly to each other. The plasma gun shaft member 2 is designed as a tube-like extension member of the second portion 15B of the connector member 1 for the supply of the media and energy required for the operation of the plasma gun assembly from the connector member 1 to the plasma gun head member 3. In the example shown in FIG. 2*b*, the plasma gun shaft member 2 is of essentially straight shape; further embodiments of the plasma gun shaft member are illustrated in other figures and will be explained herein after.

For the creation of the plasma torch, there is provided the plasma gun head member 3. It has an essentially cylindrical basic shape, the general outer diameter thereof being essentially equal to the one of the plasma gun shaft member 2. The connector member 1 is provided with a circular opening 17 facing the plasma gun shaft member 2, having a diameter which corresponds to the outer diameter of the plasma gun shaft member 2 and serving for fixing the latter one to the connector member 1. At the bottom of this opening 17, there is provided a groove 18. Further, the connector member 1 is provided with three continuous bores 19 running parallel to the central longitudinal axis 25 of the plasma gun assembly and being evenly distributed there around for receiving three screws 6 needed for fixing the plasma gun shaft member 2 to the connector member 1. At the lower face of the portion 15A of the connector member 1, there are provided four terminal members 20, 21, 22 and 23. These terminal members serve for connecting the plasma gun assembly to a supply of electric energy, to a supply of liquid cooling medium, to a supply of plasma gas and to a supply of powdery coating material required for the operation of the plasma gun assembly. In the present example, the terminal members 20, 21 and 23, thereby, are provided with male threads for the connection of correspondingly designed supply pipes, and the terminal member 22 is designed as the one portion of a plug-and-socket connection. The conduits, channels and conductors running from the terminal members 20, 21, 22 and 23 through the interior of the connector member 1 to the plasma gun shaft member 2 are not shown in FIG. 2A in order to improve the clarity of the illustration.

The plasma gun shaft member 2 is provided with s rib 26 at its rear face which is directed towards the connector member 1. Furthermore, the plasma gun shaft member 2 comprises a collar member surrounding its outer surface. The distance between this collar member 27 and the rear end face of the plasma gun shaft member essentially corresponds to the depth of the aforementioned circular opening 17 provided in the portion 15B of the connector member 1. Evenly distributed along the periphery of the collar member 27, three internal threads 28 are provided.

The other end of the plasma gun shaft member 2, i.e. the end opposite to the connector member 1, is provided with a cylindrically shaped recess 30. The bottom of this recess 30 comprises a groove 31. The bottom of the groove 31 has two threaded blind holes located in a certain distance from each other. The plasma gun head member 3 is provided with a cylindrical shoulder 36 which corresponds in shape and size to the cylindrically shaped recess 30 provided at the end of the plasma gun shaft member 2. The end portion of the plasma gun head member 3 facing the plasma gun shaft member 2 is provided with a rib 34 corresponding in shape, size and position with the groove 31 provided in the plasma gun shaft member 2. At the level of this rib 34, two bores 33 run in longitudinal direction through the plasma gun head member 3.

In order to fix the three modular units 1, 2 and 3 to each other to assemble the plasma gun assembly of the invention, the plasma gun head member 3 is fixed to the plasma gun shaft member 2 by positioning the plasma gun head member on the related end of the plasma gun shaft member 2, inserting the two screws 7 through the bores 33 of the plasma gun head assembly 3 and screwing in the screws 7 into the threaded blind holes 31. A preliminary alignment between the plasma gun head member 3 and the plasma gun shaft member 2, thereby, is ensured, on the one hand, by the engagement of the cylindrical shoulder 36 with the cylindrical recess 30 and, on the other hand, by the engagement of the rib 34 with the groove 31. Thereafter, the plasma gun shaft member 2, serving as an extension, is fixed to the connector member 1. For this purpose, the screws 6 are inserted into the bores 19 of the connector member 1 and screwed into the internal threads 28 of the collar member 27. A preliminary alignment between the plasma gun shaft member 2 and the connector member, thereby, is ensured by the engagement of the rib 26 with the groove 18. The exact alignment and positioning of the plasma gun head member 3 with reference to the shaft member 2 as well as of the shaft member 2 with reference to the connector member 1 is realized by plug members engaging socket members, as will be further described in detail herein after. It is understood that the plasma gun assembly can also be assembled in reverse order.

Figure 2G:
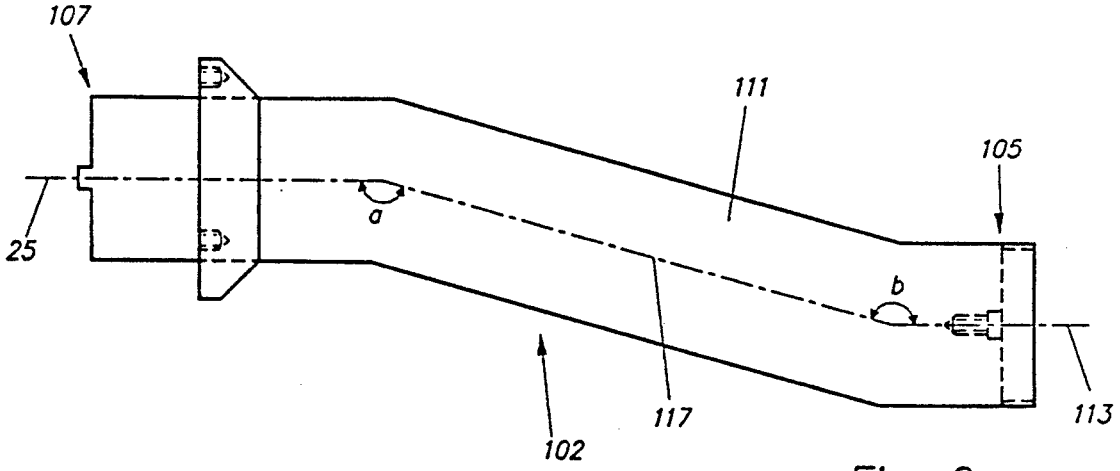
FIGS. 2*g* to 2*i* show diagrammatic views of different embodiments of plasma gun shaft members.
Figure 2H:
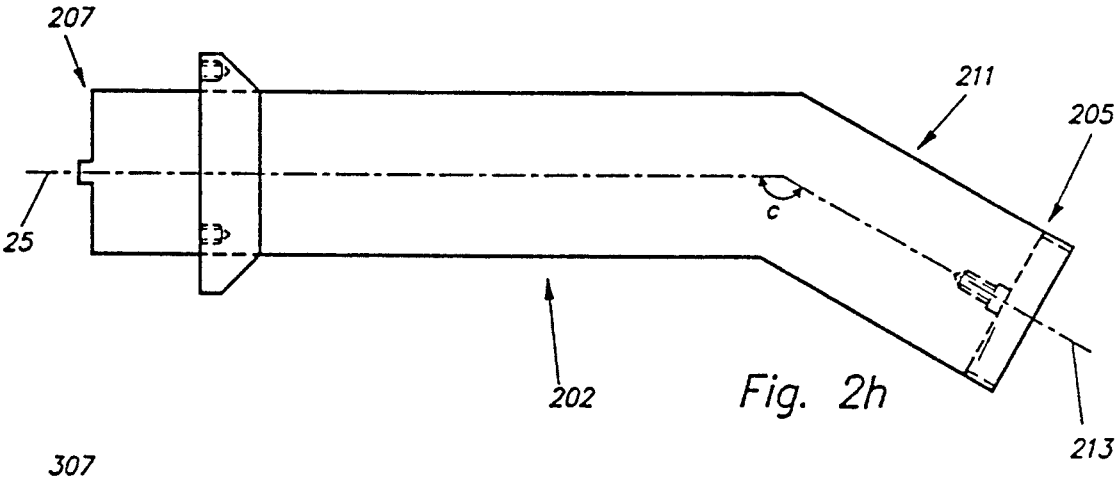
Figure 2I:
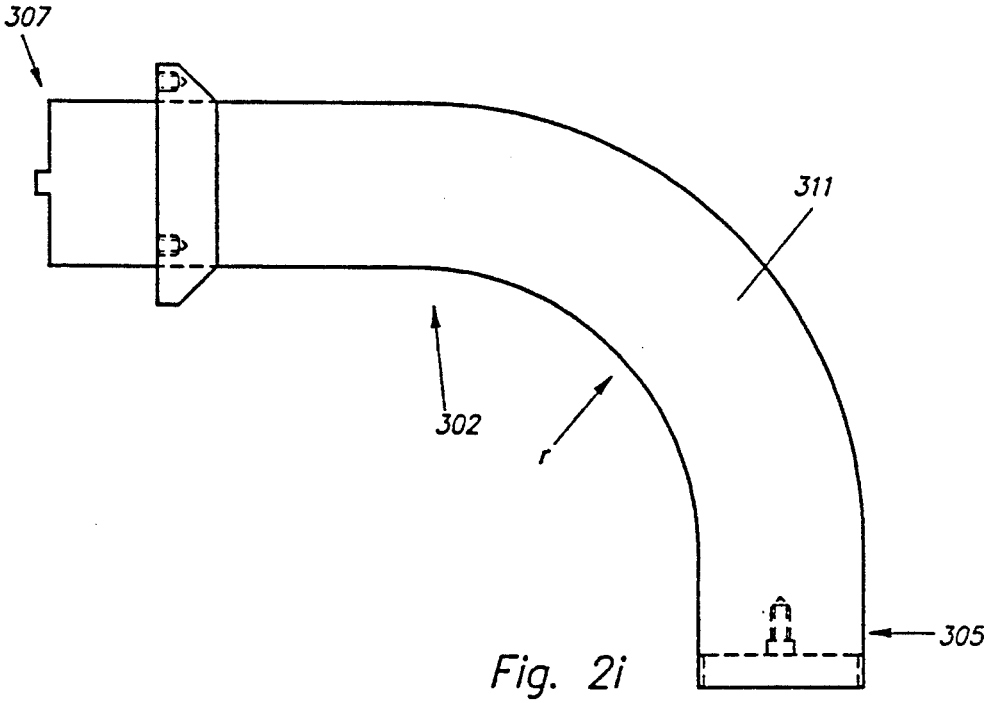

FIGS. 2*g* to 2*i* show some further embodiments of plasma gun shaft members. Particularly, FIG. 2*g* shows a swan-necked plasma gun shaft member 102, while in FIG. 2*h* an angled plasma gun shaft member 202 and in FIG. 2*i* a curved plasma gun shaft member 302 is shown. The interconnection of these plasma gun shaft members 102, 202 and 302, respectively, with the plasma gun head member 3 and the connector member 1, respectively, is effected in the same way as explained in connection with reference to FIGS. 2*a* to 2*c*.

In the case of the swan-necked plasma gun shaft member 102 shown in FIG. 2*g*, the end portion 105 facing the plasma gun head member runs parallel to the end portion 107 facing the connector member. The parallel offset of the two end portions 105 and 107 can be preset by properly choosing the length of the central portion 111 and the angle a between the longitudinal axis 25 of the end portion 107 and the longitudinal axis 117 of the central portion 111. It is understood that the angle b between the central longitudinal axis 117 of the central portion 111 and the central longitudinal axis 113 of the end portion 105 facing the plasma gun head member 3 is equal to the aforementioned angle a.

Of course, it is also possible that the angle a is different from the angle b. Thereby, the angular orientation of the plasma gun head member 3 connected to the end portion 105 of the plasma gun shaft member 102 can be varied with reference to the longitudinal central axis 113. A plasma gun shaft mender 102 designed according FIG. 2*g*, for instance, renders possible to provide the interior surface of a cylindrical hollow workpiece which has only a small open end with a coating. If the plasma gun shaft member 102 with the plasma gun head member 3 connected thereto is rotated around the axis 25, after the plasma gun assembly has been inserted into the interior of such a workpiece, in this manner, a cavity having a much greater diameter than the diameter of the open end can be coated.

FIG. 2*h* shows an embodiment of a plasma gun shaft member 202 having an end portion 205 extending in a certain angle c to the central longitudinal axis 25 of the plasma gun assembly. By varying this angle c between the longitudinal central axis 25 of the plasma gun assembly and the longitudinal axis 213 of the end portion 205 of the plasma gun shaft member 202, the angular orientation of the plasma gun head member to be connected to the free end of the portion 205 can be influenced. Thus, the magnitude of the aforementioned angle c has a direct influence of the angle under which the plasma torch escapes from the plasma gun head member. Additionally, by varying the length of the angled portion 211, the position of the plasma gun head member can be influenced with regard to the central longitudinal axis 25 of the plasma gun assembly.

In FIG. 2*i*, there is shown a still further embodiment of a plasma gun shaft member 302 in which a portion 311 of the shaft member 302 is of curved design. By using a plasma gun assembly incorporating such a shaft member 302, even curved tubes and similar workpieces can be provided with a coating on its interior surfaces.

Consequently, by using the same basic plasma gun assembly with differently designed shaft members (e.g. shaft member 2 according to FIG. 2*b*, shaft member 102 according to FIG. 2*g*, shaft member 202 according to FIG. 2*h* or shaft member 302 according to FIG. 2*i*), it is possible to coat inner surfaces of workpieces with different shapes. In order to provide tortuous cavities consisting of a plurality of partial surfaces, the plasma gun shaft members 2, 102, 202 and 302 can be used one after the other one in the most suitable order in order to coat the individual partial surfaces of a complex workpiece in the most efficient way. It is understood that the afore mentioned angles a, b and c as well as the radius r (cf. FIG. 2*i*) of the plasma gun shaft members 102, 202 and 302 can be varied in a wide range, and that also other designs and shapes of the plasma gun shaft member are possible.

Figure 3C:
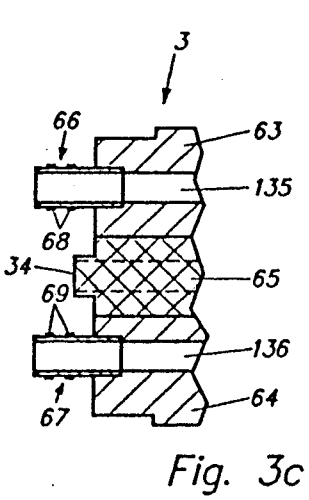
FIGS. 3*a* to 3*f* show longitudinal sectional views of different portions of the plasma gun assembly for the illustration of the design of the plug-and-socket connections and the face-to-face connections.
Figure 3B:
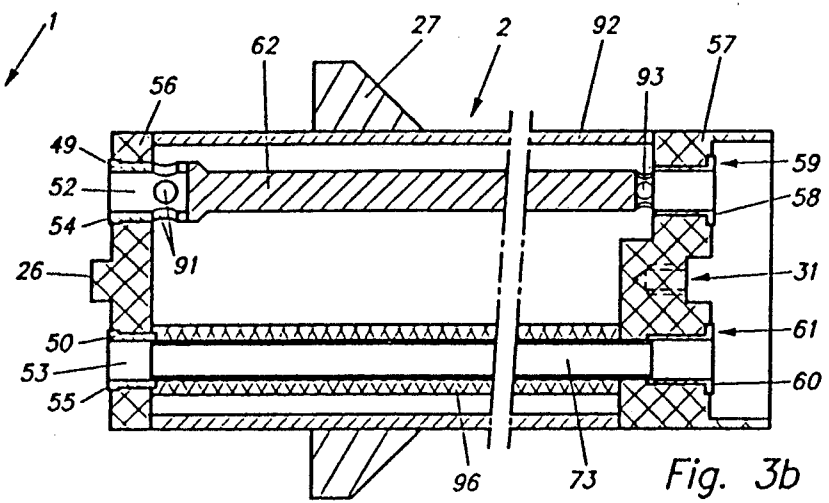
Figure 3A:
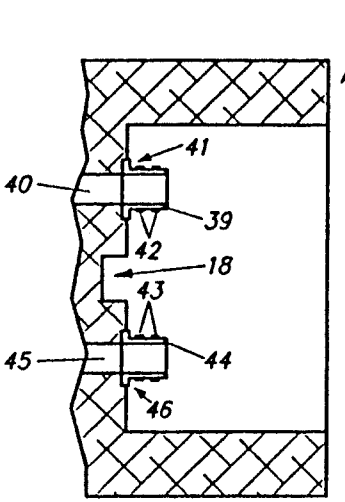
Figure 3F:
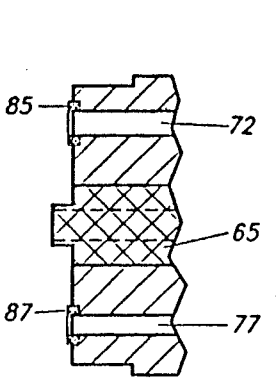

The FIGS. 3*a*–3*c* each show partial sectional views of the three units 1, 2 and 3, respectively, for the illustration of the plug-and-socket connections between the cooling water conduits 40, 45, 52, 53 on the one hand as well as between the cooling water conduits 52, 53 and the cooling water channels 135, 136 on the other hand. These plug-and-socket connections comprise a plug member 39 cooperating with a socket member 49, a plug member 44 cooperating with a socket member 50, a plug member 66 cooperating with a socket member 58, and a plug member 67 cooperating with a socket member 60. The FIGS. 3*d*–3*f* each show partial sectional views of the three units 1, 2 and 3, respectively, for the illustration of the face-to-face connections between the plasma gas conduits 75, 76, 77 as well as between the plasma powder conduits 70, 71, 72. These face-to-face connections comprise an annular sealing member 84 cooperating with a shoulder 79, an annular sealing member 85 cooperating with a shoulder 80, an annular sealing member 86 cooperating with a shoulder 81, and an annular sealing member 87 cooperating with a shoulder 82.

Figure 3E:
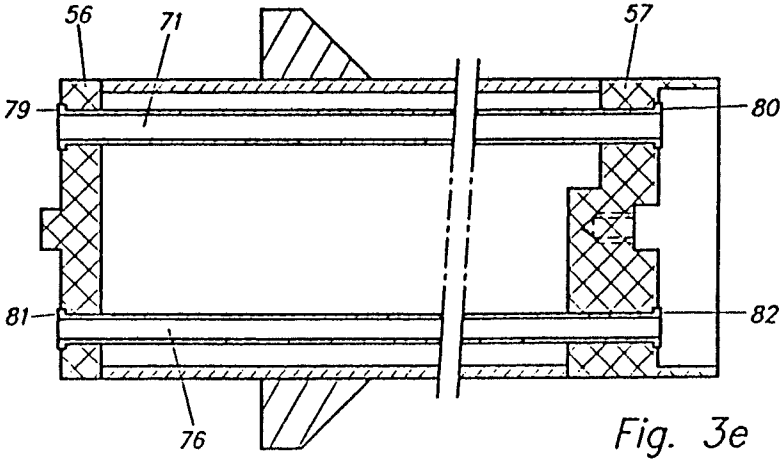
Figure 3D:
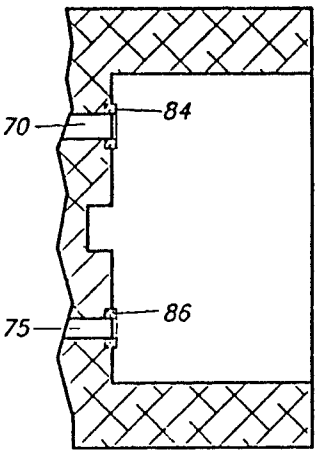

The FIGS. 3*b* and 3*e* each show a partial sectional view of the plasma gun shaft member 2. Both ends thereof are provided with a closure cap member 56 and 57, respectively, made of a plastic material with high thermal resistance. These closure cap members 56 and 57 serve for fixing the two cooling water conduits 52 and 53 as well as for fixing the plasma powder conduit 71 end the plasma gas conduit 76 in the interior of the plasma gun shaft member 2.

A particularity of the plasma gun assembly of the invention lies in the fact that cooling water circulates in the cooling water conduits 40, 45, 52, 53 and the cooling water channels 135, 136, while by means of these metallic conduits the electric energy required for the operation of the plasma gun assembly is fed from the connector member 1 to the plasma gun head member 3. Each of the socket members 49, 58 is provided with radially extending channels 91, 93 located in the interior of the plasma gun shaft member 2 leading into the interior of the jacket tube 92 of the shaft member 2. Thereby, the cooling water can flow out of the conduit 52 and the socket member 49, respectively, into the interior of the shaft member 2 at the beginning thereof and flow there through. At the opposite end of the shaft member 2, the cooling water flows through the radially extending channels 93 into the socket member 58 and is led via the socket member 66 into the cooling water channel 135.

The electric connection between the two socket members 49 and 58 is realized by means of a rod-shaped conductor member 62.

The exact function of the cooling water circulation will be further described herein after with reference to FIGS. 4, 4*a* and 4*b*. As the two cooling water conduits 52, 53 have a different electric potential, the two closure caps 56, 57 simultaneously serve as insulating members between the socket members 49, 50, 58 and 60. Additionally, as the cooling water conduits and the cooling water channels are connected in series via the plasma gun head member 3, it is necessary to use an electrically not or only very low conductive cooling medium, as for example very pure water.

The plasma powder conduits 70, 71 and 72 as well as the plasma gas conduits 75, 76 and 77 which are illustrated in FIGS. 3*e*–3*f* can be connected to each other by means of face-to-face connections. As the basic design of the modules has already been explained herein before, the following description of these figures can be limited to the important details of the plug-and-socket connections and the face-to-face connections.

For connecting the cooling water conduits 40, 45 running through the connector member 1 with the conduits 52, 53 running through the plasma gun shaft member 2, plug-and-socket connections are provided. These plug-and-socket connections comprise in each case a metallic plug member 39, 44 and a metallic socket member 49, 50. Each of the plug members 39, 44 are designed such that the have a collar 41, 46 at their rearward end. If the plug members 39, 44 are plugged into the related socket members 49, 50 and the connector member 1 fixed to the plasma gun shaft member 2 by means of the aforementioned screw connection, the collar 41 abuts against the front face 54 of the socket member 49 and the collar 46 abuts against the front face 55 of the socket member 50, whereby in each case an electrical connection is established between the related plug and socket members. Via these electrical contact faces, the electric energy can be conducted from the one conduit to the related other conduit. By means of the rib members 26 and 34 engaging the grooves 18, 31 located between the plug-and-socket connections, a good electrical insulation between the two plug-and-socket connections lying in different electrical potential is ensured. In order to provide for a sealed connection with reference to the cooling water circulating into these plug-and-socket connections, the plug members 39, 44 are provided with annular sealing members 42, 43.

Essentially in the same manner designed are the plug-and-socket connections for the cooling water and for the electric energy, comprising the plug members 66, 67 and the socket members 58, 60, between the plasma gun shaft member 2 and the plasma gun head member 3. The main difference lies in the fact that the plasma gun head member 3 comprises a metallic anode base body member 63 and a metallic cathode base body member 64. The cathode base body member 64 is designed such that it serves also for conducting the electric current to the cathode, while the anode base body member 63 ensures the flow of the current to the anode. Instead of providing a separate conduit, the channels 135, 136 required for the cooling of the plasma gun head member 3 are directly built into the afore mentioned anode base body member 63 and into the cathode base body member 64. Since these two body members 63, 64 consist of metallic material, a uniform cooling effect of the entire plasma gun head member 3 is achieved. Furthermore, it is not necessary that the two plug members 66, 67 have to be provided with a collar since, upon plugging the plug members 66, 67 into the socket members 58 60, the front faces 59, 61 of the socket members 58, 60 come into contact with the anode base body member 62 and the cathode base body member 64 and thereby ensure an electrically conductive connection. The plug members 39, 44, 66, 67 engaging the related socket members 49, 50, 58, 60 also serve to center and align the plasma gun head member 3 with reference to the plasma gun shaft member 2 and the plasma gun shaft member 2 with reference to the connector member 1, respectively.

As a seal for the cooling water, the plug members 66, 67, again, are provided with annular sealing members 68, 69.

The connections between the plasma powder conduits 70, 71, 72 as well as between the plasma gas conduits 75, 76, 77 are designed as face-to-face connections. For this purpose, the two conduits 71 and 76 running through the plasma gun shaft member 2 are provided at their ends with shoulders 79, 80, 81, 82. The plasma powder conduit 70 of the connector member 1 is provided, at its end, with an annular sealing member 84, the plasma powder conduit 72 of the plasma gun head member 3 is provided, at its end, with an annular sealing member 85, the plasma gas conduit 75 of the connector member 1 is provided, at its end, with an annular sealing member 86, and the plasma gas conduit running through the plasma gun head member is provided, at its end, with an annular sealing member 87. Thus, upon fixing the plasma gun shaft member 2 to the connector member 1, the shoulder 79 will be pressed against the sealing member 84 and the shoulder 81 will be pressed against the sealing member 86, thereby sealing the joint between the conduits 70, 71 and between the conduits 75, 76. Correspondingly, upon fixing the plasma gun shaft member 2 to the plasma gun head member, the shoulder 80 will be pressed against the sealing member 85 and the shoulder 82 will be pressed against the sealing member 87, thereby sealing the joint between the conduits 71, 72 and between the conduits 76, 77.

As such a plasma gun assembly creates a very high temperature by the plasma torch, on the one hand, the plasma gun head assembly 3 and, on the other hand, also the plasma gun shaft assembly 2 must be cooled. This is particularly true during the coating operation of the inner walls of bores, tubes and similar hollow workpieces where the created heat cannot easily flow away. The cooling conditions are particularly unfavorable if the coating operation is performed under vacuum conditions.

Figure 4B:
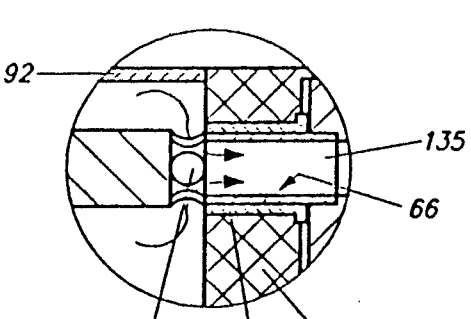
FIGS. 4, 4*a* and 4*b* show diagrammatic longitudinal sectional views of the plasma gun assembly for the illustration of the design of the cooling.
Figure 4A:
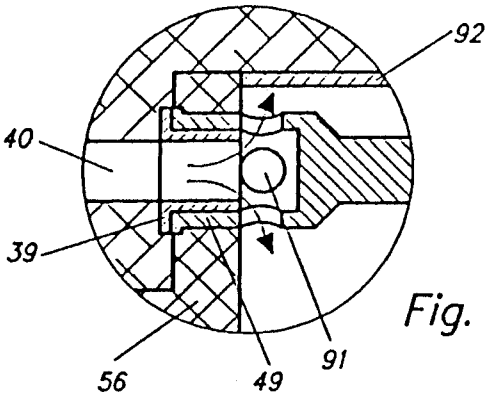
Figure 4:
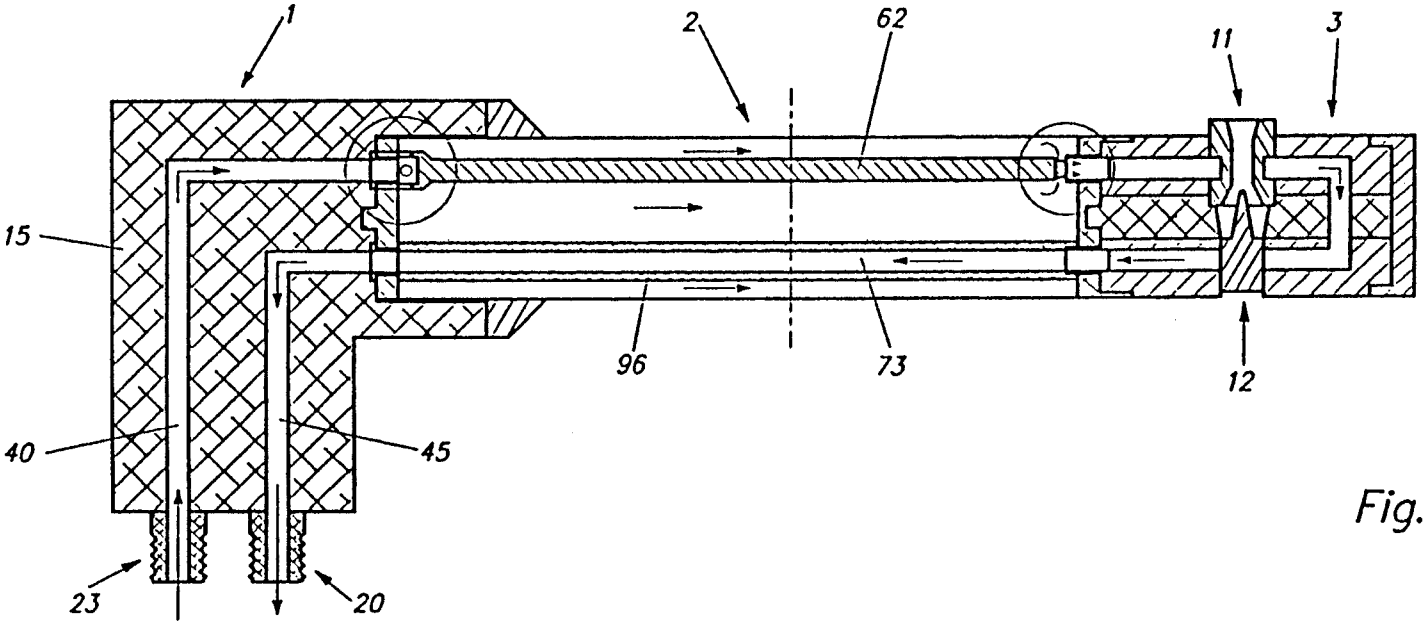

In FIG. 4, there is illustrated the cooling circuit in the plasma gun assembly of the invention. Thereby, again, the three units 1, 2 and 3 of the plasma gun assembly are shown in a diagrammatic longitudinal sectional view whereby only the essential elements and parts are shown. Additionally, in FIGS. 4*a* and 4*b*, two detailed sectional views are shown in a greater scale.

A cooling for a plasma gun assembly is particularly important for its plasma gun head assembly 3 as well as for its plasma gun shaft assembly 2. In order to ensure that the three modular units 1, 2 and 3 comprise as little as possible plug-and-socket connections and face-to-face connections, a series connected cooling circuit is provided in the plasma gun assembly of the invention. In other words, this means that the anode nozzle 11 and the cathode assembly 12 in the plasma gun head member 3 are connected, as far as the cooling is concerned, one behind the other one and, thus, are flown through by the cooling liquid in quick succession.

The cooling water is supplied to the terminal member 23 of the connector member 1 via a not shown pipe and enters the cooling water conduit 40 provided in the connector member 1 in a direction running radially to the central longitudinal axis of the plasma gun assembly. Thereafter, the flowing direction of the cooling water is deflected by 90° in the connector member 1. Now, the cooling water flows into the plug-and-socket connection comprising the plug member 39 and the socket member 49. By means of the radially extending channels 91 provided in the socket member 49, the cooling water can escape from the conduit 40 and flow into the jacket tube 92 of the plasma gun shaft member 2. Thereby, the cooling water can flow through the shaft member 2 in its whole available cross section. At the other end of the plasma gun shaft member 2, the cooling water flows through the radially extending channels 93 into the plug-and-socket connection constituted by the plug member 66 and the socket member 58. From the aforementioned plug-and-socket connection, the cooling water finally flows into the cooling water channel 135 provided in the plasma gun head member 3. For clarity's sake, the annular sealing members required in these plug-and-socket connections are not shown in these FIGS. 4, 4*a* and 4*b*.

In the interior of the plasma gun head member 3, the cooling water initially flows from the cooling water channel 135 provided in the anode base body member 63 to the anode nozzle 11 and flows there around. Then, the cooling water flow is deflected and thereby penetrates an insulating body member 65 inserted between the anode base body member 63 and the cathode base body member 64 to be led to the cathode assembly 12 where it flows there around. The annular channels provided in the anode nozzle 11 as well as in the cathode member support 13 cannot be seen in the illustration according to FIGS. 4, 4*a* and 4*b* and will be described in detail herein after in connection with the detailed description of the plasma gun head member 3.

The back flow of the cooling water out of the plasma gun head member 3 takes place through a cooling water conduit 73 provided in the plasma gun shaft member 2. This conduit 73 is provided with a surrounding jacket 96 which improves the electric insulation between the conductor member 62 and the conduit 73 which have different electric potential; thus, possibly occurring leakage currents are reduced or eliminated. From the conduit 72, the cooling water flows back to the connector member 1 where it finally escapes the connector member 1 through the channel 45 and the terminal member 20.

Such a cooling design has the advantage that, due to the series connection of the anode nozzle 11 and the cathode assembly 12, as far as the cooling is concerned, only one cooling circuit is required. A condition therefor is, however, that very pure or ultra pure water is used as a cooling liquid which comprises only a very low electrical conductivity. A further advantage is that the jacket tube 92 of the plasma gun shaft member is flown through along its entire cross section; thus, the entire shaft member 2 is efficiently cooled.

In studying the FIGS. 4, 4*a* and 4*b*, it must be considered that the plasma gun assembly is shown in a longitudinal sectional view of two different, in FIG. 4 arbitrary combined planes for the sake of illustrating the cooling circuit with better clarity. Furthermore, it must be considered that the plasma gas conduit and the plasma powder conduit is omitted for the sake of clarity.

Figure 5B:
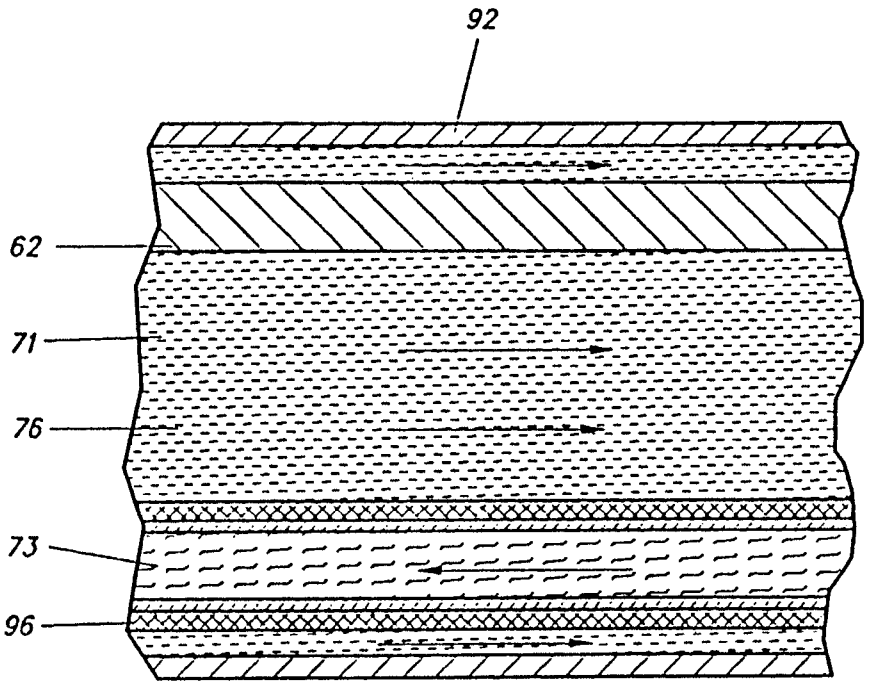
FIGS. 5*a* and 5*b* show a cross sectional view and a partial longitudinal sectional view, respectively, of the plasma gun shaft member.
Figure 5A:
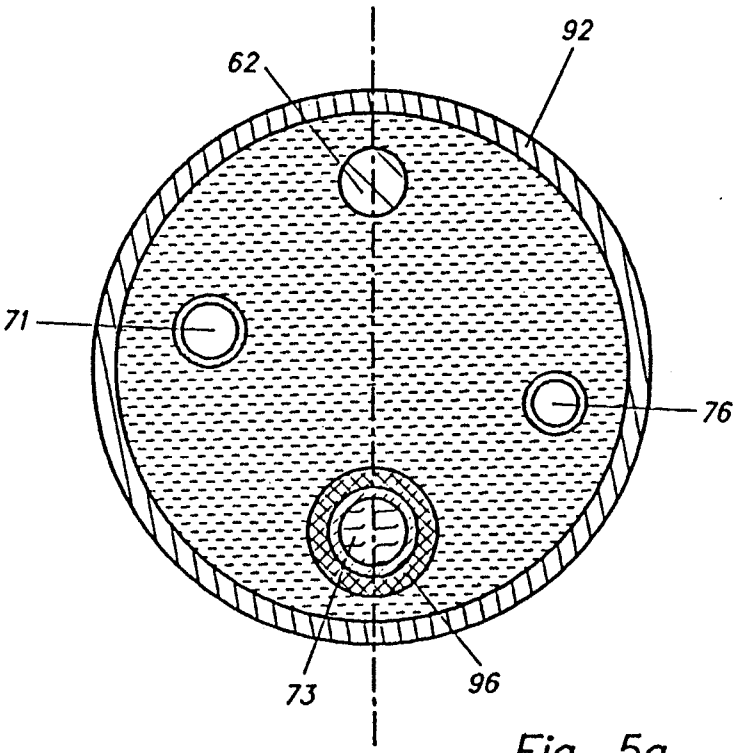

In FIG. 5*a*, there is shown a cross sectional view of the plasma gun shaft member 2, while FIG. 5*b* shows a partial longitudinal sectional view of the plasma gun shaft member 2. In the interior of the jacket tube member 92 of the plasma gun shaft member 2, the tube-shaped cooling water conduit 73, the rod-shaped electrical conductor 62 as well as the plasma powder conduit 71 and the plasma gas conduit 76 can be recognized. The surrounding jacket 96 of the cooling water conduit 73 which serves also as an electric insulation is shown as well. In these views, it can be seen very well that the jacket tube member 92 of the plasma gun shaft member 2 is flown through by the cooling water essentially over its entire cross sectional area; thereby, a very good cooling efficiency is achieved. It must be noted that these two views are shown in a greater scale for the sake of clarity.

Figure 6A:
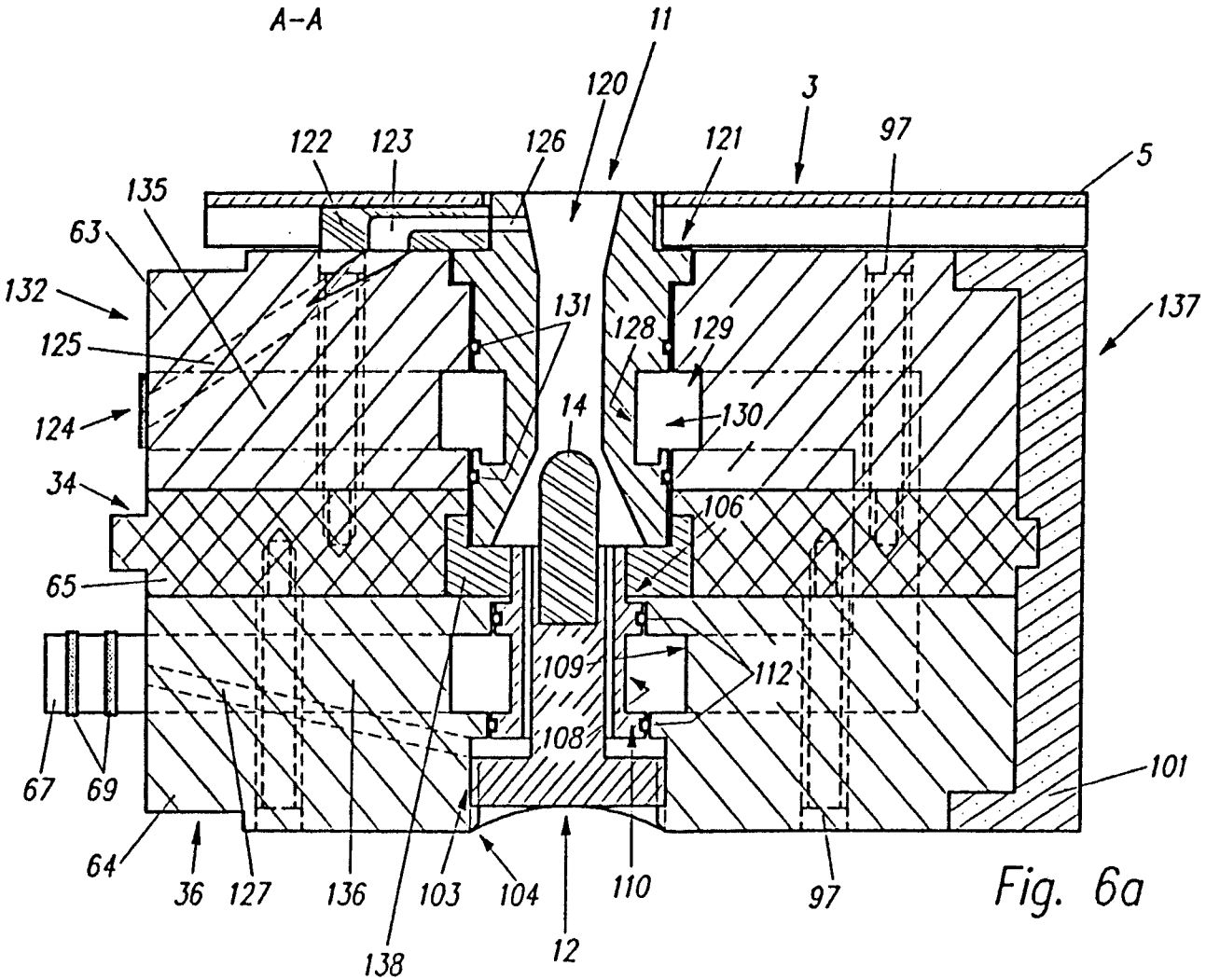
FIGS. 6*a* to 6*c* show a longitudinal sectional view and a cross sectional view of the plasma gun head member, respectively, as well as diagrammatic back face view of the plasma gun head assembly.
Figure 6C:
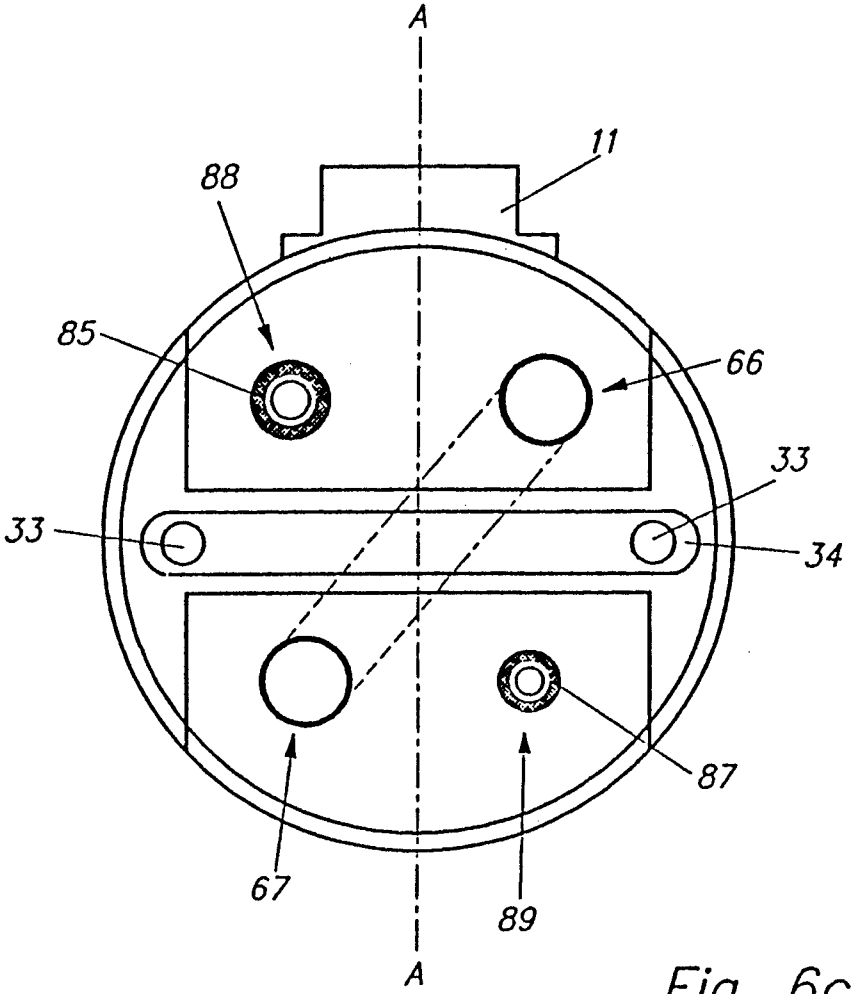
Figure 6B:
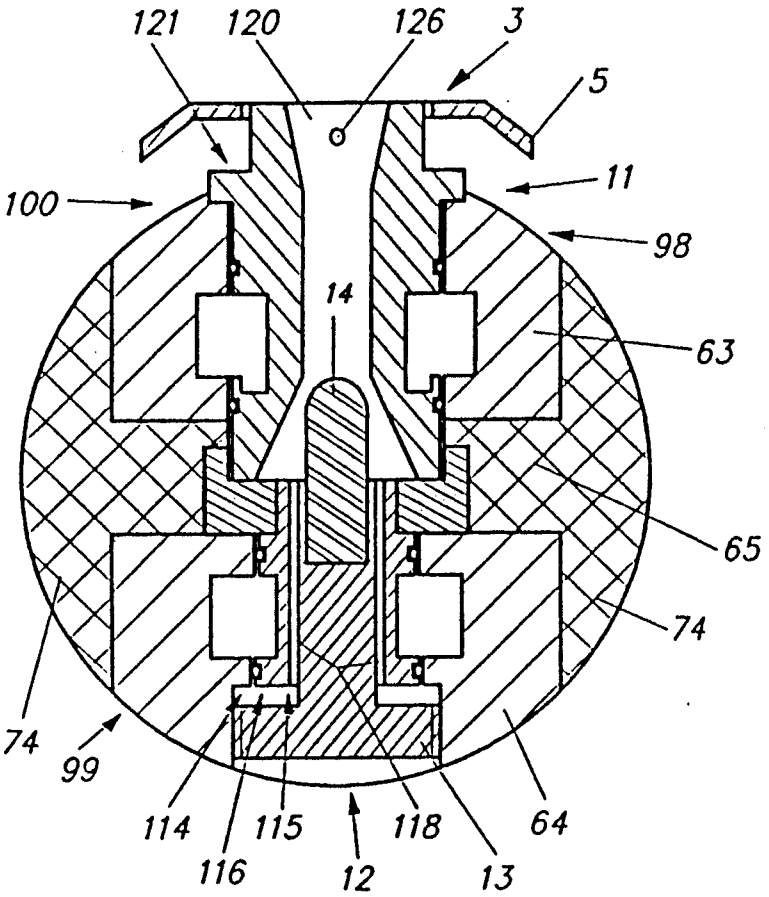

FIG. 6*a* shows a longitudinal sectional view, FIG. 6*b* a cross sectional view and FIG. 6*c* a rear view of the plasma gun head member 3 whereby all these views are shown in an enlarged scale. As known in the art, the plasma gun head member serves for creating a plasma torch by means of which a powdery material supplied to the head member is molten and accelerated such that the powdery material moving with very high speed can be applied to the surface of a substrate in order to provide the latter one with a coating. For the operation of the plasma gun head member, electrical energy as well as a number of liquid and gaseous media are required.

The plasma gun head member 3 is of generally cylindrical design and essentially comprises a cathode base body member 64 with a cathode assembly 5 received therein, an anode base body member 63 with an anode nozzle 11 received therein as well as an insulating member 65 electrically insulating the cathode base body member 64 from the anode base body member 63. The plasma gun head member is provided with a cylindrical shoulder 36 located at the end thereof which faces the plasma gun shaft member 2. The anode base body member 63 is made of a metallic material and essentially has a rectangular configuration whereby one surface 98 of the anode base body member 63 is rounded. This upper rounded surface 98 simultaneously forms a portion of the outside of the plasma gun head member 3. The cathode base body member 63, consisting of a metallic material as well, has a mirror-inverted shape with regard to the one of the anode base body member 64 and also comprises a rounded portion 99 which forms a lower outside portion of the plasma gun head member 3.

The insulating body member 69 is located between the inner surface of the cathode base body member 64 and the inner surface of the anode base body member 63. In order to improve the electrical insulation between the cathode base body member 64 and the anode base body member 63, the insulating base body member 65 is provided with cylinder segment shaped flange portion 74 running along its longitudinal edges; these flanges 74 partially cover the plane lateral outer surfaces of the anode base body member 63 and the cathode base body member 64. The front face of the plasma gun head member 3 lying opposite to the plasma gun shaft member 2 is provided with an insulating cap 101 made of ceramic material.

The plasma gun head member 3 is mechanically assembled by means of a number of screws 97, a part thereof connecting the cathode base body member 64 to the insulating body member 65, and an other part thereof connecting the anode base body member 63 to the insulating body member 65. In order not to impair a good electrical insulation between the cathode base body member 64 and the anode base body member 63, these two body member 63, 64 are screwed into the insulating body member 65 at different positions.

A cathode assembly 12 comprises a cylindrical cathode member support 13 with a cathode member 14, being made of tungsten and being inserted into the cathode member support 13 from the upper side thereof. The cathode member support 13 is provided with an outer tread 103 located at the rear end thereof by means of which it is screwed into a corresponding threaded portion 104 of the cathode base body member 64. By means of this screwed connection 103, 104, also a reliable electrical connection between the anode base body member 64 and the cathode assembly 65 is ensured. With this design, the longitudinal axis of the cathode assembly 12 runs perpendicular to the main longitudinal axis of the plasma gun head member 3. The cathode member support 13 is surrounded at its upper end by an insulating washer 138 made of ceramic material.

In order to determine the axial position of the cathode assembly 12, the cathode member support 13 is provided with a shoulder 106 which positively abuts with its front face to the cathode base body member 64. At the level of the cooling water channel 136, the cathode member support 13 is provided with an annular groove 108. The cathode base body member 64 also is provided with an annular groove 109 corresponding to the aforementioned groove 108 in shape and position such that the two grooves 108 and 109 together form an annular cooling channel 110. Above and below this channel 110 there is provided an annular sealing member 112 surrounding the cathode member 13 in order to seal the cooling channel 110.

For the supply of plasma gas, the cathode member support 13 as well as the cathode base body member 64 are provided with an annular groove 114 and 115, respectively, which together form an annular channel 116 located below the aforementioned annular cooling channel 110. A plasma gas channel 127 coming from the front face 132 of the plasma gun head member 3 opens into the aforementioned annular channel 116. Starting from this annular channel 116, longitudinal channels 118 run through the plasma gun head member 3 along the peripheral region of the cathode member support 13 of the cathode 14 to the bores 120 of the anode nozzle 11.

The anode nozzle 11 generally has a cylindrical shape with a continuos aperture 120 which conically opens at both sides of the nozzle 11. The anode nozzle 11 is inserted into the anode base body member 63 from the outside of the plasma gun head member 3 such that the longitudinal axis of the anode nozzle 11 extends perpendicularly to the central longitudinal axis of the plasma gun head member 3. The anode nozzle 11 is provided with a shoulder 121 serving as a stop member for defining the exact axial position of the nozzle 11. This shoulder 121 abuts against the front face of a bore 100 provided in the anode base body member 63 upon inserting the anode nozzle 11 into the plasma gun head member 3. This contact surface simultaneously serves for electrically connecting the anode nozzle 11 to the anode base body member 63.

As can be seen in FIG. 6*a*, the cathode member 14 projects into the opening 120 of the anode nozzle 11 in the assembled condition of the plasma gun head member 3. The anode nozzle 11 is fixed in the anode base body member 63 by means of a clamping member 122 which is screwed to the anode base body member 63 by a not shown screw. The clamping member 122 is designed such that it connects a plasma powder channel 125 to a bore 126 radially running into the interior of the anode nozzle 11 via an internal bore 123 provided in the clamping member 122.

As already described in connection with the cathode member 13, the anode nozzle 11 is also provided with an annular groove 128 which forms an annular cooling channel 130 in conjunction with a annular cooling channel 130 provided in the anode base body member 63. Again, in order to seal the annular cooling channel 130, suitable annular sealing members 131 are provided.

Referring to FIG. 6*c* showing a view of the rear side 132 of the plasma gun head member 3 facing the plasma gun shaft member 2, the rib member 34 engaging the correspondingly shaped groove in the shaft member can be seen. Furthermore, all connections of the conduits for a supply of the media required for the operation of the plasma gun head member 3 are led to this rear face 132 and open into plug-and-socket connections and face-to-face connections. For supplying cooling water to the plasma gun head member 3, the plug 66 is provided. From this plug 66 a cooling water channel 135 leads into the interior of the anode base body member 63 where it initially opens into the annular cooling channel 130 extending around the annular nozzle 11. Thereafter, the cooling water channel 135 runs further through the anode base body member 63, is then deflected by 90° downwards, runs trough the insulating body member 65 into the cathode body member 64, is again deflected by 90° and finally opens into the annular cooling channel 110 of the cathode member support 13. It must be noted that the cooling water channel is designated with reference numeral 136 starting from the transition from the insulating body member 65 to the cathode base body member 64. Finally, the cooling water channel 136 ends at the plug member 67 where the cooling water leaves the plasma gun member 3.

The two tube-like shaped plug members 66 and 67 are inserted into the cathode base body member 64 and the anode base body member 63, respectively, such that a reliable contact with these body members is ensured.

In order to shield the plasma gun head member 3 against the influence of heat, an angled heat protection shield member 5 is provided which is connected to the plasma gun head member 3 at that side where the annual nozzle 11 is located. As can be seen in FIG. *6b*, the outer surface of the heat protection shield member 5 flushes with the outer surface of the annular nozzle 11.

The operation of such a plasma gun head member 3 is well known to any person skilled in the art; thus, only some particularities and advantages of the plasma gun head member 3 as herein before described will be further explained. An essential advantages of the plasma gun head member 3 of the present invention is that both the anode nozzle 11 as well as the cathode assembly 12 are accessible from the outside of the plasma gun head member 3 with the result that they can easily and quickly be exchanged by the operator of the plasma gun assembly. Due to the fact that the operational parts of the plasma gun head member 3 are mounted therein along an axis running perpendicular to the main central axis of the plasma gun assembly, the plasma torch is escaping in radial direction from the plasma gun head member. The advantage is that also tortuous portions of cavities can be evenly and homogeneously coated which is particularly important in the case of coating the interior surfaces of tubes and similar work pieces.

The plasma gas led along the peripheral region of the cathode member support 13 of the cathode 14 through the channels 118 efficiently cools the cathode support member 13. Furthermore, the plasma gas is preheated by this kind of supply with the result that the efficiency of the plasma gun assembly is improved. The cathode base body member 64, being made of metallic material, is used for the supply of electric current to the cathode 14. As already mentioned, the plug member 67 is designed both as a connector for the interconnection of the cooling channels and as an electrical contact member for the supply of electric energy to the plasma gun head member 3. As the cathode member support 13 and, thereby, the cathode 14 itself as well as the plug member 67 are in direct contact with the cathode base body member 64, the electric current is conducted with high efficiency.

Due to the fact that the cathode and the anode of the plasma gun head member 3 are connected in series as far as the cooling water circuit is concerned, the number of the connections between the plasma gun head member and the plasma gun shaft member can be reduced to a minimum. It is understood that the cooling liquid must have a high specific electric resistance, because the cathode assembly member 12 and the anode nozzle 11 have different electrical potentials, in order to avoid the occurrence of leakage currents. As already mentioned, very pure water can be used as a cooling medium.

The connecting member, e.g. in the form of the clamping member 122, for connecting the plasma powder channel 125 to the plasma powder conduit 126 radially extending into the interior of the anode nozzle 11 is, exchangeable. If different clamping members 122 having different cross sections of the plasma powder feeding channel are provided, the injection speed of the powder injected into the plasma torch can be preselected by exchanging the clamping member 122.

What is claimed is:

1. A plasma gun assembly particularly for applying a coating to the inner surfaces of hollow spaces and cavities, comprising:

a plasma gun head member;

a plasma gun shaft member;

a connector member adapted to be connected to means for supplying electric energy, to means for supplying a cooling medium and for removing the cooling medium therefrom, to means for supplying plasma gas, and to means for supplying coating material;

first feeding means for conducting said electric energy from said connector member to said plasma gun head member, second feeding means for conducting said cooling medium from said connector member to said plasma gun head member and back to said connector member, third feeding means for conducting said plasma gas from said connector member to said plasma gun head member, and fourth feeding means for conducting said coating material from said connector member to said plasma gun head member;

said connector member, said plasma gun shaft member and said plasma gun head member being connected to each other along a longitudinal axis, said axis constituting a longitudinal central axis of the plasma gun assembly;

said connector member, said plasma gun shaft member and said plasma gun head member being designed as individually exchangeable modules which can be removed, exchanged and assembled by the operator of the plasma gun assembly;

said first, second, third and fourth feeding means all being located and extending in the interiors of said connector member, of said plasma gun shaft member and of said plasma gun head member.

2. A plasma gun assembly according to claim 1 in which said connector member, said plasma gun shaft member and said plasma gun head member each comprise matching plug-and-socket connector means and/or matching face-to-face connector means for interconnecting said first, second, third and fourth feeding means between said connector member, said plasma gun shaft member and said plasma gun head member, respectively.

3. A plasma gun assembly according to claim 2 in which said plasma gun shaft member comprises a hollow jacket tube member made of metallic material provided at both of its ends with said plug-and-socket connector means and/or face-to-face connector means whereby a portion of said first feeding means for conducting said electric energy from said connector member to said plasma gun head member, a portion of said second feeding means for conducting said cooling medium from said connector member to said plasma gun head member and back to said connector member, a portion of said third feeding means for conducting said plasma gas from said connector member to said plasma gun head member, and a portion of said fourth feeding means for conducting said coating material from said connector member to said plasma gun head member extend between said connector means provided at both ends of said plasma gun shaft member in the interior of said hollow jacket tube member.

4. A plasma gun assembly according to claim 3 in which said portion of said first feeding means running through the interior of said hollow jacket tube member comprise a first rod-shaped conductor member and a second tube-shaped conductor member.

5. A plasma gun assembly according to claim 4 in which at least one of said rod-shaped conductor member and said tube-shaped conductor member is provided with an electrically insulating jacket.

6. A plasma gun assembly according to claim 3 in which said portion of said second feeding means for conducting said cooling medium from said connector member to said plasma gun head member is constituted by said hollow jacket tube member whereby said second tube-shaped conductor member serves for conducting the cooling medium back from the plasma gun head member to the connector member.

7. A plasma gun assembly according to claim 3 in which the end of said plasma gun shaft member adapted to be connected to said plasma gun head member comprises a closure cap member which is provided with two socket members, and in which said plasma gun head member comprises an anode base body member and a cathode base body member, both of these body members being equipped with a plug member matching in shape and position with said two socket members, one of said two socket members being connected to said rod-shaped conductor member and the other of said two socket members being connected to said tube-shaped conductor member.

8. A plasma gun assembly according to claim 7 in which the interior of said socket member which is connected to said rod-shaped conductor member is communicating with the interior of said hollow jacket tube member by means of radially extending channels.

9. A plasma gun assembly according to claim 1 in which said plasma gun head member is connected to said plasma gun shaft member by means of two screws, and in which said plasma gun shaft member is connected to said connector member by means of three screws.

10. A plasma gun assembly according to claim 1 in which said connector member comprises terminal members for connecting said connector member to said means for supplying electric energy, to said means for supplying a cooling medium and for removing the cooling medium therefrom, to said means for supplying plasma gas, and to said means for supplying coating material, said terminal members being radially arranged with reference to said longitudinal central axis of the plasma gun assembly.

11. A plasma gun assembly according to claim 1 in which said plasma gun shaft member has an essentially angled shape.

12. A plasma gun assembly according to claim 1 in which said plasma gun shaft member has an essentially curved shape.

13. A plasma gun assembly according to claim 1 in which said plasma gun shaft member has an essentially swan-necked shape.

14. A plasma gun head member adapted to be used in a plasma gun assembly according to claim 1, comprising:

an anode base body member equipped with an anode nozzle;

a cathode base body member bearing a cathode member projecting into said anode nozzle;

an insulating body member inserted between said anode base body member and said cathode base body member;

said anode base body member, said insulating body member and said cathode base body member being fixed to each other along planes which run parallel to the central longitudinal axis of the plasma gun assembly;

said anode base body member and said cathode base body member constituting portions of the outside of the plasma gun head member;

said cathode member and said anode nozzle being inserted into said cathode base body member and said anode base body member, respectively, from the outside of the plasma gun head member in a direction running perpendicular to said central longitudinal axis of said plasma gun assembly.

15. A plasma gun head member according to claim 14 in which said insulating body member is provided with flange portions running along its longitudinal edges, said flange portions partially surrounding said anode base body member and said cathode base body member at their outer sides.

16. A plasma gun head member according to claim 14 in which conduits for the feeding of plasma gas and coating powder are provided in the interior of the plasma gun head member which run outside of said insulating body member.

17. A plasma gun head member according to claim 16 in which said first front face of the plasma gun head member is provided with all connecting members for the interconnecting channels and the cooling channels, whereby a second front face remote from the plasma gun shaft member is covered with an insulating cap member.

18. A plasma gun head member according to claim 16 in which said clamping member is provided with an internal bore interconnecting said conduit for the feeding of coating powder and said radially extending channel leading into the interior of said anode nozzle.

19. A plasma gun head member according to claim 14 in which said cathode base body member, said anode base body member and said insulating body member of the plasma gun head member together form a constructional unit having essentially cylindrical shape, the longitudinal central axis of which essentially coincides with the longitudinal central axis of the plasma gun assembly.

20. A plasma gun head member according to claim 14 in which said cathode base body member and said anode base body member are provided with cooling channels for a liquid cooling medium which are connected in series by means of an aperture in said insulating body member, said cooling channels leading to connector means provided at a first front face of the plasma gun head member which faces the plasma gun shaft member.

21. A plasma gun head member according to claim 14 in which the free front face of the plasma gun head member is covered by a cap member.

22. A plasma gun head member according to claim 14 in which said cathode base body member is connected to said insulating body member by first screw means and said anode base body member is connected to said insulating body member by second screw means, said first and second screw means being located at different positions.

23. A plasma gun head member according to claim 14 in which the plasma gun head member is provided with a plug-on protection cover member consisting of ceramic material with an aperture leaving the anode nozzle free.

24. A plasma gun head member according to claim 14 in which said cathode member is pin-shaped, and in which there is provided a cylindrical cathode member support in which said cathode member is received, said cathode member support being screwed into the cathode base body member and penetrating the cooling channel thereof.

25. A plasma gun head member according to claim 24 in which said cathode base body member and said cylindrical cathode member support are provided with annular grooves which together form an annular channel connected to the feeding means for plasma gas.

26. A plasma gun head member according to claim 25 in which said cathode base body member further comprises longitudinal channels located in its peripheral region, said longitudinal channels leading from said annular channel along the cathode member and open to the interior of the anode nozzle by frontal openings.

27. A plasma gun head member according to claim 24 in which said cathode member is made of doped tungsten.

28. A plasma gun head member according to claim 14 in which said anode base body member comprises a cylindrical bore in which said anode nozzle is plugged-in whereby said anode nozzle is fixed by means of a clamping member screwed to the anode base body member and engaging a shoulder provided on said anode nozzle.

29. A plasma gun head member according to claim 14 in which the anode nozzle is provided with a radially extending channel located outside of said anode base body member, said channel serving for feeding plasma powder as the coating material into the interior of said anode nozzle.

30. A plasma gun head member according to claim 14 in which there is provided an angled protection shield member located at the plasma gun head member close to the anode nozzle.

* * * * *